US012325905B2

(12) United States Patent
Hamataka

(10) Patent No.: US 12,325,905 B2
(45) Date of Patent: Jun. 10, 2025

(54) METHOD FOR PRODUCING HIGH-TOUGHNESS, HIGH-STRENGTH ALUMINUM ALLOY EXTRUDED MATERIAL WITH GOOD HARDENABILITY

(71) Applicant: AISIN KEIKINZOKU CO., LTD., Imizu (JP)

(72) Inventor: Yuuki Hamataka, Imizu (JP)

(73) Assignee: AISIN KEIKINZOKU CO., LTD. (JP)

( * ) Notice: Subject to any disclaimer, the term of this patent is extended or adjusted under 35 U.S.C. 154(b) by 0 days.

(21) Appl. No.: 18/107,801

(22) Filed: Feb. 9, 2023

(65) Prior Publication Data

US 2023/0272514 A1 Aug. 31, 2023

(30) Foreign Application Priority Data

Feb. 28, 2022 (JP) ..... 2022-029782

(51) Int. Cl.

*C22F 1/043* (2006.01)
*C22C 21/02* (2006.01)
*C22C 21/08* (2006.01)
*C22F 1/047* (2006.01)

(52) U.S. Cl.

CPC ..... *C22F 1/043* (2013.01); *C22C 21/02* (2013.01)

(58) Field of Classification Search

CPC ..... C22F 1/04–057
See application file for complete search history.

(56) References Cited

U.S. PATENT DOCUMENTS

2014/0166165 A1* 6/2014 Shibata ..... C22F 1/00 148/417
2017/0306465 A1† 10/2017 Skubich
2018/0171449 A1† 6/2018 Skubich

FOREIGN PATENT DOCUMENTS

CA 2637273 A1 * 10/2007 ..... B21K 1/12
CN 115449652 * 12/2022 ..... C22C 1/02
JP 2011-208251 A 10/2011

(Continued)

OTHER PUBLICATIONS

Kaufman; Fracture Resistance of Aluminum Alloys; ASM; pp. 13-14; 2001.†

(Continued)

*Primary Examiner* — Lois L Zheng
(74) *Attorney, Agent, or Firm* — Harness, Dickey & Pierce, P.L.C.

(57) ABSTRACT

A method for producing an extruded material includes: casting a billet at a casting speed of 60 mm/min or more using an alloy containing: 0.50 to 1.0% of Mg, 0.80 to 1.30% of Si, 0.10 to 0.60% of Mn, 0.05 to 0.35% of Fe, 0.35% by mass or less of Cu, less than 0.10% by mass of Cr, Zr, Zn respectively, 0.10% by mass or less of Ti, and the balance being aluminum, the alloy having 0.85 to 1.75% of stoichiometric $Mg_2S$ with 0.10 to 0.85% of excess Si, and 0.15 to 0.95% of Mn and Fe; homogenizing at 560 to 590° C. for 2 to 8 hours, cooling at 50° C./h or more; preheating at 400 to 550° C., extruding the billet into the extruded material, cooling the extruded material from 460 to 550° C. at an average rate of 350° C./min or more; and applying artificial aging.

4 Claims, 7 Drawing Sheets

| Constituent | | Composition (mass%) | | | | | | | | $Mg_2Si$ | exSi | Mn+Fe |
|---|---|---|---|---|---|---|---|---|---|---|---|---|
| | | Si | Fe | Cu | Mn | Mg | Cr | Zn | Ti | | | |
| 1 | Example | 0.95 | 0.15 | 0.00 | 0.51 | 0.77 | 0.00 | 0.01 | 0.02 | 1.35 | 0.33 | 0.66 |
| 2 | | 0.95 | 0.15 | 0.00 | 0.51 | 0.77 | 0.00 | 0.01 | 0.02 | 1.35 | 0.33 | 0.66 |
| 3 | | 0.95 | 0.15 | 0.00 | 0.51 | 0.77 | 0.00 | 0.01 | 0.02 | 1.35 | 0.33 | 0.66 |
| 4 | | 0.95 | 0.15 | 0.00 | 0.51 | 0.77 | 0.00 | 0.01 | 0.02 | 1.35 | 0.33 | 0.66 |
| 5 | | 0.95 | 0.15 | 0.00 | 0.51 | 0.77 | 0.00 | 0.01 | 0.02 | 1.35 | 0.33 | 0.66 |
| 6 | | 0.95 | 0.15 | 0.00 | 0.51 | 0.77 | 0.00 | 0.01 | 0.02 | 1.35 | 0.33 | 0.66 |
| 7 | | 0.95 | 0.15 | 0.00 | 0.51 | 0.77 | 0.00 | 0.01 | 0.02 | 1.35 | 0.33 | 0.66 |
| 8 | | 0.95 | 0.15 | 0.00 | 0.51 | 0.77 | 0.00 | 0.01 | 0.02 | 1.35 | 0.33 | 0.66 |
| 9 | | 0.95 | 0.15 | 0.00 | 0.51 | 0.77 | 0.00 | 0.01 | 0.02 | 1.35 | 0.33 | 0.66 |
| 10 | | 0.95 | 0.15 | 0.00 | 0.51 | 0.77 | 0.00 | 0.01 | 0.02 | 1.35 | 0.33 | 0.66 |
| 11 | | 0.95 | 0.15 | 0.00 | 0.51 | 0.77 | 0.00 | 0.01 | 0.02 | 1.35 | 0.33 | 0.66 |
| 12 | | 0.95 | 0.15 | 0.00 | 0.51 | 0.77 | 0.00 | 0.01 | 0.02 | 1.35 | 0.33 | 0.66 |
| 13 | | 0.95 | 0.15 | 0.00 | 0.51 | 0.77 | 0.00 | 0.01 | 0.02 | 1.35 | 0.33 | 0.66 |
| 14 | | 0.95 | 0.15 | 0.00 | 0.51 | 0.77 | 0.00 | 0.01 | 0.02 | 1.35 | 0.33 | 0.66 |
| 15 | | 0.95 | 0.15 | 0.00 | 0.51 | 0.77 | 0.00 | 0.01 | 0.02 | 1.35 | 0.33 | 0.66 |
| 16 | | 0.95 | 0.15 | 0.00 | 0.51 | 0.77 | 0.00 | 0.01 | 0.02 | 1.35 | 0.33 | 0.66 |
| 17 | | 0.95 | 0.15 | 0.00 | 0.51 | 0.77 | 0.00 | 0.01 | 0.02 | 1.35 | 0.33 | 0.66 |
| 18 | | 0.95 | 0.15 | 0.00 | 0.51 | 0.77 | 0.00 | 0.01 | 0.02 | 1.35 | 0.33 | 0.66 |
| 19 | | 0.95 | 0.15 | 0.00 | 0.51 | 0.77 | 0.00 | 0.01 | 0.02 | 1.35 | 0.33 | 0.66 |
| 20 | | 1.12 | 0.18 | 0.30 | 0.36 | 0.66 | 0.00 | 0.01 | 0.02 | 1.16 | 0.59 | 0.54 |
| 21 | | 1.12 | 0.18 | 0.30 | 0.36 | 0.66 | 0.00 | 0.01 | 0.02 | 1.16 | 0.59 | 0.54 |
| 22 | | 1.12 | 0.18 | 0.30 | 0.36 | 0.66 | 0.00 | 0.01 | 0.02 | 1.16 | 0.59 | 0.54 |
| 23 | | 1.12 | 0.18 | 0.30 | 0.36 | 0.66 | 0.00 | 0.01 | 0.02 | 1.16 | 0.59 | 0.54 |
| 24 | | 1.00 | 0.15 | 0.30 | 0.50 | 0.80 | 0.00 | 0.00 | 0.02 | 1.40 | 0.38 | 0.65 |
| 25 | | 1.00 | 0.15 | 0.30 | 0.50 | 0.80 | 0.00 | 0.00 | 0.02 | 1.40 | 0.38 | 0.65 |
| 26 | | 1.00 | 0.15 | 0.30 | 0.50 | 0.80 | 0.00 | 0.00 | 0.02 | 1.40 | 0.38 | 0.65 |
| 27 | | 1.00 | 0.15 | 0.30 | 0.50 | 0.80 | 0.00 | 0.00 | 0.02 | 1.40 | 0.38 | 0.65 |
| 28 | | 1.00 | 0.15 | 0.30 | 0.50 | 0.80 | 0.00 | 0.00 | 0.02 | 1.40 | 0.38 | 0.65 |
| 29 | | 1.00 | 0.15 | 0.30 | 0.50 | 0.80 | 0.00 | 0.00 | 0.02 | 1.40 | 0.38 | 0.65 |
| 30 | | 0.95 | 0.15 | 0.00 | 0.50 | 0.55 | 0.00 | 0.01 | 0.02 | 0.96 | 0.38 | 0.65 |
| 31 | | 0.95 | 0.15 | 0.00 | 0.50 | 0.55 | 0.00 | 0.01 | 0.02 | 0.96 | 0.38 | 0.65 |
| 32 | | 0.95 | 0.15 | 0.00 | 0.50 | 0.55 | 0.00 | 0.01 | 0.02 | 0.96 | 0.38 | 0.65 |
| 33 | | 0.95 | 0.15 | 0.00 | 0.50 | 0.55 | 0.00 | 0.01 | 0.02 | 0.96 | 0.38 | 0.65 |
| 34 | | 0.95 | 0.15 | 0.00 | 0.50 | 0.55 | 0.00 | 0.01 | 0.02 | 0.96 | 0.38 | 0.65 |
| 35 | | 0.95 | 0.15 | 0.00 | 0.50 | 0.55 | 0.00 | 0.01 | 0.02 | 0.96 | 0.38 | 0.65 |

| Constituent | | Composition (mass%) | | | | | | | | $Mg_2Si$ | exSi | Mn+Fe |
|---|---|---|---|---|---|---|---|---|---|---|---|---|
| | | Si | Fe | Cu | Mn | Mg | Cr | Zn | Ti | | | |
| 1 | Comparative Example | 0.55 | 0.18 | 0.00 | 0.00 | 0.75 | 0.00 | 0.00 | 0.01 | 1.31 | 0.07 | 0.18 |
| 2 | | 0.55 | 0.18 | 0.00 | 0.00 | 0.75 | 0.00 | 0.00 | 0.01 | 1.31 | 0.07 | 0.18 |
| 3 | | 0.55 | 0.18 | 0.00 | 0.00 | 0.75 | 0.00 | 0.00 | 0.01 | 1.31 | 0.07 | 0.18 |
| 4 | | 0.55 | 0.18 | 0.00 | 0.00 | 0.75 | 0.00 | 0.00 | 0.01 | 1.31 | 0.07 | 0.18 |
| 5 | | 0.43 | 0.18 | 0.00 | 0.00 | 0.53 | 0.00 | 0.00 | 0.01 | 0.93 | 0.07 | 0.18 |
| 6 | | 0.58 | 0.38 | 0.00 | 0.00 | 0.47 | 0.02 | 0.00 | 0.02 | 0.82 | 0.19 | 0.43 |
| 7 | | 0.58 | 0.38 | 0.00 | 0.05 | 0.47 | 0.02 | 0.00 | 0.02 | 0.82 | 0.19 | 0.43 |
| 8 | | 0.72 | 0.33 | 0.23 | 0.22 | 1.02 | 0.18 | 0.00 | 0.02 | 1.79 | 0.02 | 0.35 |
| 9 | | 0.72 | 0.33 | 0.23 | 0.22 | 1.02 | 0.18 | 0.00 | 0.02 | 1.79 | 0.02 | 0.35 |
| 10 | | 0.95 | 0.15 | 0.00 | 0.51 | 0.77 | 0.00 | 0.01 | 0.02 | 1.35 | 0.33 | 0.66 |
| 11 | | 0.95 | 0.15 | 0.00 | 0.51 | 0.77 | 0.00 | 0.01 | 0.02 | 1.35 | 0.33 | 0.66 |
| 12 | | 0.95 | 0.15 | 0.00 | 0.51 | 0.77 | 0.00 | 0.01 | 0.02 | 1.35 | 0.33 | 0.66 |
| 13 | | 0.95 | 0.15 | 0.00 | 0.51 | 0.77 | 0.00 | 0.01 | 0.02 | 1.35 | 0.33 | 0.66 |
| 14 | | 0.95 | 0.15 | 0.00 | 0.51 | 0.77 | 0.00 | 0.01 | 0.02 | 1.35 | 0.33 | 0.66 |
| 15 | | 0.95 | 0.15 | 0.00 | 0.51 | 0.77 | 0.00 | 0.01 | 0.02 | 1.35 | 0.33 | 0.66 |
| 16 | | 0.95 | 0.15 | 0.00 | 0.51 | 0.77 | 0.00 | 0.01 | 0.02 | 1.35 | 0.33 | 0.66 |
| 17 | | 0.95 | 0.15 | 0.00 | 0.51 | 0.77 | 0.00 | 0.01 | 0.02 | 1.35 | 0.33 | 0.66 |
| 18 | | 0.95 | 0.15 | 0.00 | 0.51 | 0.77 | 0.00 | 0.01 | 0.02 | 1.35 | 0.33 | 0.66 |
| 19 | | 0.95 | 0.15 | 0.00 | 0.51 | 0.77 | 0.00 | 0.01 | 0.02 | 1.35 | 0.33 | 0.66 |
| 20 | | 0.95 | 0.15 | 0.00 | 0.51 | 0.77 | 0.00 | 0.01 | 0.02 | 1.35 | 0.33 | 0.66 |
| 21 | | 0.95 | 0.15 | 0.00 | 0.51 | 0.77 | 0.00 | 0.01 | 0.02 | 1.35 | 0.33 | 0.66 |
| 22 | | 0.95 | 0.15 | 0.00 | 0.51 | 0.77 | 0.00 | 0.01 | 0.02 | 1.35 | 0.33 | 0.66 |

(56) References Cited

FOREIGN PATENT DOCUMENTS

JP 2016-020527 A 2/2016

OTHER PUBLICATIONS

Aluminum Association: International Alloy Designations and Chemical Composition Limits for Wrought Aluminum and Wrought Aluminum Alloys; Aluminum Association Arlington, VA; pp. 1-29, Jan. 2018.†

Berezhnoy; Technological Principles of Maximizing Strength in the Case of Production of Press Quenched Al—Mg—Si Alloy Extrusions; Light Metal Age Magazine; pp. 46-53; Jun. 2000.†

Parson, et al; Extrusions for Automotive Crash Applications; Proceedings from the Eleventh International Aluminum Extrusion Technology Seminar &Exposition; ET Foundation; pp. 1-16; 2016.†

Aluminum Association; Aluminum Standards and Data 2013 Metric SI; Aluminum Association; pp. 2-3, 3-13, and 3-14; 2013.†

* cited by examiner
† cited by third party

FIG. 1A

| Constituent | | Composition (mass%) | | | | | | | | $Mg_2Si$ | exSi | Mn+Fe |
|---|---|---|---|---|---|---|---|---|---|---|---|---|
| | | Si | Fe | Cu | Mn | Mg | Cr | Zn | Ti | | | |
| 1 | Example | 0.95 | 0.15 | 0.00 | 0.51 | 0.77 | 0.00 | 0.01 | 0.02 | 1.35 | 0.33 | 0.66 |
| 2 | | 0.95 | 0.15 | 0.00 | 0.51 | 0.77 | 0.00 | 0.01 | 0.02 | 1.35 | 0.33 | 0.66 |
| 3 | | 0.95 | 0.15 | 0.00 | 0.51 | 0.77 | 0.00 | 0.01 | 0.02 | 1.35 | 0.33 | 0.66 |
| 4 | | 0.95 | 0.15 | 0.00 | 0.51 | 0.77 | 0.00 | 0.01 | 0.02 | 1.35 | 0.33 | 0.66 |
| 5 | | 0.95 | 0.15 | 0.00 | 0.51 | 0.77 | 0.00 | 0.01 | 0.02 | 1.35 | 0.33 | 0.66 |
| 6 | | 0.95 | 0.15 | 0.00 | 0.51 | 0.77 | 0.00 | 0.01 | 0.02 | 1.35 | 0.33 | 0.66 |
| 7 | | 0.95 | 0.15 | 0.00 | 0.51 | 0.77 | 0.00 | 0.01 | 0.02 | 1.35 | 0.33 | 0.66 |
| 8 | | 0.95 | 0.15 | 0.00 | 0.51 | 0.77 | 0.00 | 0.01 | 0.02 | 1.35 | 0.33 | 0.66 |
| 9 | | 0.95 | 0.15 | 0.00 | 0.51 | 0.77 | 0.00 | 0.01 | 0.02 | 1.35 | 0.33 | 0.66 |
| 10 | | 0.95 | 0.15 | 0.00 | 0.51 | 0.77 | 0.00 | 0.01 | 0.02 | 1.35 | 0.33 | 0.66 |
| 11 | | 0.95 | 0.15 | 0.00 | 0.51 | 0.77 | 0.00 | 0.01 | 0.02 | 1.35 | 0.33 | 0.66 |
| 12 | | 0.95 | 0.15 | 0.00 | 0.51 | 0.77 | 0.00 | 0.01 | 0.02 | 1.35 | 0.33 | 0.66 |
| 13 | | 0.95 | 0.15 | 0.00 | 0.51 | 0.77 | 0.00 | 0.01 | 0.02 | 1.35 | 0.33 | 0.66 |
| 14 | | 0.95 | 0.15 | 0.00 | 0.51 | 0.77 | 0.00 | 0.01 | 0.02 | 1.35 | 0.33 | 0.66 |
| 15 | | 0.95 | 0.15 | 0.00 | 0.51 | 0.77 | 0.00 | 0.01 | 0.02 | 1.35 | 0.33 | 0.66 |
| 16 | | 0.95 | 0.15 | 0.00 | 0.51 | 0.77 | 0.00 | 0.01 | 0.02 | 1.35 | 0.33 | 0.66 |
| 17 | | 0.95 | 0.15 | 0.00 | 0.51 | 0.77 | 0.00 | 0.01 | 0.02 | 1.35 | 0.33 | 0.66 |
| 18 | | 0.95 | 0.15 | 0.00 | 0.51 | 0.77 | 0.00 | 0.01 | 0.02 | 1.35 | 0.33 | 0.66 |
| 19 | | 0.95 | 0.15 | 0.00 | 0.51 | 0.77 | 0.00 | 0.01 | 0.02 | 1.35 | 0.33 | 0.66 |
| 20 | | 1.12 | 0.18 | 0.30 | 0.36 | 0.66 | 0.00 | 0.01 | 0.02 | 1.16 | 0.59 | 0.54 |
| 21 | | 1.12 | 0.18 | 0.30 | 0.36 | 0.66 | 0.00 | 0.01 | 0.02 | 1.16 | 0.59 | 0.54 |
| 22 | | 1.12 | 0.18 | 0.30 | 0.36 | 0.66 | 0.00 | 0.01 | 0.02 | 1.16 | 0.59 | 0.54 |
| 23 | | 1.12 | 0.18 | 0.30 | 0.36 | 0.66 | 0.00 | 0.01 | 0.02 | 1.16 | 0.59 | 0.54 |
| 24 | | 1.00 | 0.15 | 0.30 | 0.50 | 0.80 | 0.00 | 0.00 | 0.02 | 1.40 | 0.36 | 0.65 |
| 25 | | 1.00 | 0.15 | 0.30 | 0.50 | 0.80 | 0.00 | 0.00 | 0.02 | 1.40 | 0.36 | 0.65 |
| 26 | | 1.00 | 0.15 | 0.30 | 0.50 | 0.80 | 0.00 | 0.00 | 0.02 | 1.40 | 0.36 | 0.65 |
| 27 | | 1.00 | 0.15 | 0.30 | 0.50 | 0.80 | 0.00 | 0.00 | 0.02 | 1.40 | 0.36 | 0.65 |
| 28 | | 1.00 | 0.15 | 0.30 | 0.50 | 0.80 | 0.00 | 0.00 | 0.02 | 1.40 | 0.36 | 0.65 |
| 29 | | 1.00 | 0.15 | 0.30 | 0.50 | 0.80 | 0.00 | 0.00 | 0.02 | 1.40 | 0.36 | 0.65 |
| 30 | | 0.85 | 0.15 | 0.00 | 0.50 | 0.55 | 0.00 | 0.01 | 0.02 | 0.96 | 0.36 | 0.65 |
| 31 | | 0.85 | 0.15 | 0.00 | 0.50 | 0.55 | 0.00 | 0.01 | 0.02 | 0.96 | 0.36 | 0.65 |
| 32 | | 0.85 | 0.15 | 0.00 | 0.50 | 0.55 | 0.00 | 0.01 | 0.02 | 0.96 | 0.36 | 0.65 |
| 33 | | 0.85 | 0.15 | 0.00 | 0.50 | 0.55 | 0.00 | 0.01 | 0.02 | 0.96 | 0.36 | 0.65 |
| 34 | | 0.85 | 0.15 | 0.00 | 0.50 | 0.55 | 0.00 | 0.01 | 0.02 | 0.96 | 0.36 | 0.65 |
| 35 | | 0.85 | 0.15 | 0.00 | 0.50 | 0.55 | 0.00 | 0.01 | 0.02 | 0.96 | 0.36 | 0.65 |

FIG. 1B

| Constituent | | Composition (mass%) | | | | | | | | $Mg_2Si$ | exSi | Mn+Fe |
|---|---|---|---|---|---|---|---|---|---|---|---|---|
| | | Si | Fe | Cu | Mn | Mg | Cr | Zn | Ti | | | |
| 1 | Comparative Example | 0.55 | 0.18 | 0.00 | 0.00 | 0.75 | 0.00 | 0.00 | 0.01 | 1.31 | 0.07 | 0.18 |
| 2 | | 0.55 | 0.18 | 0.00 | 0.00 | 0.75 | 0.00 | 0.00 | 0.01 | 1.31 | 0.07 | 0.18 |
| 3 | | 0.55 | 0.18 | 0.00 | 0.00 | 0.75 | 0.00 | 0.00 | 0.01 | 1.31 | 0.07 | 0.18 |
| 4 | | 0.55 | 0.18 | 0.00 | 0.00 | 0.75 | 0.00 | 0.00 | 0.01 | 1.31 | 0.07 | 0.18 |
| 5 | | 0.43 | 0.18 | 0.00 | 0.00 | 0.53 | 0.00 | 0.00 | 0.01 | 0.93 | 0.07 | 0.18 |
| 6 | | 0.56 | 0.38 | 0.08 | 0.05 | 0.47 | 0.02 | 0.00 | 0.02 | 0.82 | 0.19 | 0.43 |
| 7 | | 0.58 | 0.38 | 0.08 | 0.05 | 0.47 | 0.02 | 0.00 | 0.02 | 0.82 | 0.19 | 0.43 |
| 8 | | 0.72 | 0.33 | 0.23 | 0.22 | 1.02 | 0.18 | 0.00 | 0.02 | 1.79 | 0.02 | 0.35 |
| 9 | | 0.72 | 0.33 | 0.23 | 0.22 | 1.02 | 0.18 | 0.00 | 0.02 | 1.79 | 0.02 | 0.35 |
| 10 | | 0.95 | 0.15 | 0.00 | 0.51 | 0.77 | 0.00 | 0.01 | 0.02 | 1.35 | 0.33 | 0.66 |
| 11 | | 0.95 | 0.15 | 0.00 | 0.51 | 0.77 | 0.00 | 0.01 | 0.02 | 1.35 | 0.33 | 0.66 |
| 12 | | 0.95 | 0.15 | 0.00 | 0.51 | 0.77 | 0.00 | 0.01 | 0.02 | 1.35 | 0.33 | 0.66 |
| 13 | | 0.95 | 0.15 | 0.00 | 0.51 | 0.77 | 0.00 | 0.01 | 0.02 | 1.35 | 0.33 | 0.66 |
| 14 | | 0.95 | 0.15 | 0.00 | 0.51 | 0.77 | 0.00 | 0.01 | 0.02 | 1.35 | 0.33 | 0.66 |
| 15 | | 0.95 | 0.15 | 0.00 | 0.51 | 0.77 | 0.00 | 0.01 | 0.02 | 1.35 | 0.33 | 0.66 |
| 16 | | 0.95 | 0.15 | 0.00 | 0.51 | 0.77 | 0.00 | 0.01 | 0.02 | 1.35 | 0.33 | 0.66 |
| 17 | | 0.95 | 0.15 | 0.00 | 0.51 | 0.77 | 0.00 | 0.01 | 0.02 | 1.35 | 0.33 | 0.66 |
| 18 | | 0.95 | 0.15 | 0.00 | 0.51 | 0.77 | 0.00 | 0.01 | 0.02 | 1.35 | 0.33 | 0.66 |
| 19 | | 0.95 | 0.15 | 0.00 | 0.51 | 0.77 | 0.00 | 0.01 | 0.02 | 1.35 | 0.33 | 0.66 |
| 20 | | 0.95 | 0.15 | 0.00 | 0.51 | 0.77 | 0.00 | 0.01 | 0.02 | 1.35 | 0.33 | 0.66 |
| 21 | | 0.95 | 0.15 | 0.00 | 0.51 | 0.77 | 0.00 | 0.01 | 0.02 | 1.35 | 0.33 | 0.66 |
| 22 | | 0.95 | 0.15 | 0.00 | 0.51 | 0.77 | 0.00 | 0.01 | 0.02 | 1.35 | 0.33 | 0.66 |

FIG. 2A

| Production condition | | Casting speed | HOMO temperature | HOMO time | Cooling rate after HOMO | BLT temperature | Extrusion speed | Cooling start temperature of extruded material after extrusion | Cooling rate | Heat treatment temperature | Heat treatment time |
|---|---|---|---|---|---|---|---|---|---|---|---|
| | | 60 mm/min or more | 560~590℃ | 2 h to 8 h | 50℃/h or more | 400℃ or more | 5 m/min or more | 460 ~550℃ | 350℃/min or more | 160 ~220℃ | 2 h to 12 h |
| 1 | Example | 70 | 570 | 3 | 200 | 500 | 5 | 490 | 405 | 180 | 6 |
| 2 | | 70 | 570 | 3 | 200 | 500 | 5 | 490 | 405 | 180 | 6 |
| 3 | | 70 | 570 | 3 | 200 | 500 | 5 | 490 | 405 | 180 | 6 |
| 4 | | 70 | 570 | 3 | 200 | 500 | 5 | 490 | 405 | 180 | 6 |
| 5 | | 70 | 570 | 3 | 200 | 500 | 10 | 540 | 425 | 180 | 6 |
| 6 | | 70 | 570 | 3 | 200 | 500 | 10 | 540 | 425 | 180 | 6 |
| 7 | | 70 | 570 | 3 | 200 | 500 | 10 | 540 | 425 | 180 | 6 |
| 8 | | 70 | 570 | 3 | 200 | 500 | 10 | 540 | 425 | 180 | 6 |
| 9 | | 70 | 570 | 3 | 200 | 500 | 10 | 540 | 600 | 180 | 6 |
| 10 | | 70 | 570 | 3 | 200 | 500 | 10 | 540 | 600 | 180 | 6 |
| 11 | | 70 | 570 | 3 | 200 | 500 | 10 | 540 | 600 | 180 | 6 |
| 12 | | 70 | 570 | 3 | 200 | 500 | 10 | 540 | 600 | 180 | 6 |
| 13 | | 70 | 570 | 3 | 200 | 500 | 10 | 540 | 600 | 180 | 6 |
| 14 | | 70 | 570 | 3 | 200 | 500 | 10 | 540 | 600 | 180 | 6 |
| 15 | | 70 | 570 | 3 | 200 | 500 | 10 | 540 | 600 | 180 | 6 |
| 16 | | 70 | 570 | 3 | 200 | 500 | 10 | 540 | 600 | 180 | 6 |
| 17 | | 70 | 570 | 3 | 200 | 500 | 5 | 490 | 800 | 180 | 6 |
| 18 | | 70 | 570 | 3 | 200 | 500 | 5 | 490 | 800 | 180 | 6 |
| 19 | | 70 | 570 | 3 | 200 | 500 | 5 | 490 | 800 | 180 | 6 |
| 20 | | 70 | 570 | 3 | 200 | 500 | 5 | 490 | 405 | 180 | 6 |
| 21 | | 70 | 570 | 3 | 200 | 500 | 10 | 540 | 425 | 180 | 6 |
| 22 | | 70 | 570 | 3 | 200 | 500 | 10 | 540 | 425 | 180 | 6 |
| 23 | | 70 | 570 | 3 | 200 | 500 | 10 | 540 | 425 | 180 | 6 |
| 24 | | 70 | 570 | 3 | 200 | 500 | 5 | 540 | 350 | 180 | 6 |
| 25 | | 70 | 570 | 3 | 200 | 500 | 5 | 540 | 600 | 180 | 6 |
| 26 | | 70 | 570 | 3 | 200 | 500 | 5 | 540 | 700 | 180 | 6 |
| 27 | | 70 | 570 | 3 | 200 | 500 | 5 | 540 | 700 | 180 | 6 |
| 28 | | 70 | 570 | 3 | 200 | 500 | 5 | 540 | 1000 | 180 | 6 |

FIG. 2B

| Production condition | | Casting speed | HOMO temperature | HOMO time | Cooling rate after HOMO | BLT temperature | Extrusion speed | Cooling start temperature of extruded material after extrusion | Cooling rate | Heat treatment temperature | Heat treatment time |
|---|---|---|---|---|---|---|---|---|---|---|---|
| | | 60 mm/min or more | 560~590℃ | 2 h to 8 h | 50℃/h or more | 400℃ or more | 5 m/min or more | 460 ~550℃ | 350℃/min or more | 160 ~220℃ | 2 h to 12 h |
| 29 | Example | 70 | 570 | 3 | 200 | 500 | 5 | 540 | 1000 | 180 | 6 |
| 30 | Example | 70 | 570 | 3 | 200 | 500 | 10 | 530 | 600 | 180 | 6 |
| 31 | Example | 70 | 570 | 3 | 200 | 500 | 10 | 530 | 600 | 180 | 6 |
| 32 | Example | 70 | 570 | 3 | 200 | 500 | 10 | 530 | 800 | 180 | 6 |
| 33 | Example | 70 | 570 | 3 | 200 | 500 | 10 | 530 | 800 | 180 | 6 |
| 34 | Example | 70 | 570 | 3 | 200 | 500 | 10 | 530 | 1200 | 180 | 6 |
| 35 | Example | 70 | 570 | 3 | 200 | 500 | 10 | 530 | 1200 | 180 | 6 |
| 1 | Comparative Example | 70 | 570 | 3 | 40 | 500 | 10 | 540 | 70 | 200 | 2 |
| 2 | Comparative Example | 70 | 570 | 3 | 40 | 500 | 10 | 540 | 600 | 200 | 36 |
| 3 | Comparative Example | 65 | 570 | 3 | 40 | 500 | 10 | 540 | 600 | 200 | 2 |
| 4 | Comparative Example | 65 | 570 | 3 | 40 | 500 | 10 | 540 | 600 | 200 | 36 |
| 5 | Comparative Example | 80 | 570 | 3 | 30 | 500 | 10 | 540 | 30 | 200 | 2 |
| 6 | Comparative Example | 70 | 560 | 6 | 30 | 500 | 8 | 520 | 50 | 200 | 2 |
| 7 | Comparative Example | 70 | 560 | 6 | 30 | 500 | 7.5 | 520 | 50 | 200 | 4 |
| 8 | Comparative Example | 50 | 560 | 6 | 40 | 500 | 4.0 | 470 | 950 | 180 | 4 |
| 9 | Comparative Example | 50 | 560 | 6 | 40 | 500 | 4 | 470 | 950 | 180 | 4 |
| 10 | Comparative Example | 70 | 570 | 3 | 200 | 500 | 12 | 560 | 1000 | 180 | 6 |
| 11 | Comparative Example | 70 | 570 | 3 | 200 | 500 | 12 | 560 | 1000 | 180 | 6 |
| 12 | Comparative Example | 70 | 570 | 3 | 200 | 500 | 12 | 565 | 1000 | 180 | 6 |
| 13 | Comparative Example | 70 | 570 | 3 | 200 | 500 | 12 | 565 | 1000 | 180 | 6 |
| 14 | Comparative Example | 70 | 570 | 3 | 200 | 480 | 5.0 | 450 | 800 | 180 | 6 |
| 15 | Comparative Example | 70 | 570 | 3 | 200 | 480 | 5.0 | 450 | 800 | 180 | 6 |
| 16 | Comparative Example | 70 | 570 | 3 | 200 | 480 | 5 | 440 | 600 | 180 | 6 |
| 17 | Comparative Example | 70 | 570 | 3 | 200 | 480 | 5 | 440 | 800 | 180 | 6 |
| 18 | Comparative Example | 70 | 570 | 3 | 40 | 500 | 5 | 480 | 650 | 180 | 6 |
| 19 | Comparative Example | 70 | 570 | 3 | 40 | 500 | 5 | 480 | 650 | 180 | 6 |
| 20 | Comparative Example | 70 | 570 | 3 | 40 | 500 | 5 | 480 | 800 | 180 | 6 |
| 21 | Comparative Example | 70 | 570 | 3 | 40 | 500 | 5.0 | 480 | 800 | 180 | 6 |
| 22 | Comparative Example | 70 | 570 | 3 | 40 | 500 | 5.0 | 480 | 1000 | 180 | 6 |

FIG. 3A

| Evaluation | | T5 tensile strength (MPa) | T5 proof stress (MPa) | T5 elongation (%) | Charpy impact value (J/cm²) | DSC | Microstructure | | Total evaluation |
|---|---|---|---|---|---|---|---|---|---|
| | | | | | | | Crystal grain size | Shape | |
| | | 260 MPa or more | 240 MPa or more | 8% or more | 20 J/cm² or more | Amount of precipitation (integral value)200 ~ | 50 μm or less | ---- | |
| 1 | Example | 321 | 275 | 16 | 26 | 220 | 30 | Fibrous structure | ○ |
| 2 | | 325 | 278 | 17 | 26 | 240 | 30 | | ○ |
| 3 | | 317 | 270 | 16 | 26 | 240 | 30 | | ○ |
| 4 | | 316 | 271 | 14 | 25 | 240 | 30 | | ○ |
| 5 | | 322 | 273 | 14 | 25 | 250 | 30 | | ○ |
| 6 | | 320 | 274 | 14 | 26 | 250 | 30 | | ○ |
| 7 | | 317 | 272 | 13 | 26 | 240 | 30 | | ○ |
| 8 | | 320 | 277 | 13 | 26 | 220 | 30 | | ○ |
| 9 | | 341 | 314 | 12 | 20 | 290 | 30 | | ○ |
| 10 | | 329 | 302 | 13 | 25 | 250 | 30 | | ○ |
| 11 | | 320 | 290 | 13 | 28 | 200 | 30 | | ○ |
| 12 | | 317 | 287 | 14 | 22 | 270 | 30 | | ○ |
| 13 | | 275 | 247 | 15 | 21 | 270 | 30 | | ○ |
| 14 | | 305 | 275 | 13 | 25 | 240 | 30 | | ○ |
| 15 | | 303 | 271 | 13 | 24 | 240 | 30 | | ○ |
| 16 | | 272 | 244 | 14 | 28 | 210 | 30 | | ○ |
| 17 | | 334 | 316 | 12 | 28 | 200 | 30 | | ○ |
| 18 | | 332 | 315 | 12 | 26 | 270 | 30 | | ○ |
| 19 | | 334 | 316 | 13 | 28 | 250 | 30 | | ○ |
| 20 | | 316 | 271 | 14 | 25 | 250 | 30 | | ○ |
| 21 | | 320 | 274 | 14 | 25 | 240 | 30 | | ○ |
| 22 | | 317 | 272 | 13 | 25 | 240 | 30 | | ○ |
| 23 | | 320 | 277 | 13 | 25 | 240 | 30 | | ○ |
| 24 | | 273 | 255 | 14 | 29 | 210 | 30 | | ○ |
| 25 | | 311 | 292 | 13 | 29 | 260 | 30 | | ○ |
| 26 | | 328 | 305 | 12 | 29 | 260 | 30 | | ○ |
| 27 | | 328 | 305 | 12 | 29 | 250 | 30 | | ○ |
| 28 | | 338 | 310 | 12 | 28 | 220 | 30 | | ○ |

FIG. 3B

| Evaluation | | T5 tensile strength (MPa) | T5 proof stress (MPa) | T5 elongation (%) | Charpy impact value (J/cm²) | DSC | Microstructure | | Total evaluation |
|---|---|---|---|---|---|---|---|---|---|
| | | | | | | | Crystal grain size | Shape | |
| | | 260 MPa or more | 240 MPa or more | 8% or more | 20 J/cm² or more | Amount of precipitation (integral value)200 ~ | 50 μm or less | — | |
| 29 | Example | 335 | 310 | 12 | 28 | 280 | 30 | Fibrous structure | ○ |
| 30 | Example | 278 | 250 | 14 | 29 | 210 | 30 | Fibrous structure | ○ |
| 31 | Example | 278 | 255 | 14 | 29 | 210 | 30 | Fibrous structure | ○ |
| 32 | Example | 280 | 249 | 13 | 27 | 270 | 30 | Fibrous structure | ○ |
| 33 | Example | 279 | 249 | 23 | 28 | 270 | 30 | Fibrous structure | ○ |
| 34 | Example | 281 | 250 | 13 | 28 | 250 | 30 | Fibrous structure | ○ |
| 35 | Example | 281 | 255 | 13 | 28 | 250 | 30 | Fibrous structure | ○ |
| 1 | Comparative Example | 260 | 218 | 16 | 17 | 360 | 150 | Crystalized structure throughout | × |
| 2 | Comparative Example | 248 | 223 | 10 | 30 | 200 | 150 | Crystalized structure throughout | × |
| 3 | Comparative Example | 267 | 230 | 13 | 24 | 290 | 150 | Crystalized structure throughout | × |
| 4 | Comparative Example | 248 | 223 | 10 | 30 | 210 | 150 | Crystalized structure throughout | × |
| 5 | Comparative Example | 228 | 199 | 15 | 36 | 120 | 150 | Crystalized structure throughout | × |
| 6 | Comparative Example | 250 | 229 | 12 | 32 | 130 | 100 | Flattened structure | × |
| 7 | Comparative Example | 250 | 229 | 12 | 32 | 130 | 100 | Flattened structure | × |
| 8 | Comparative Example | 353 | 322 | 12 | 29 | 210 | 100 | Flattened structure | × |
| 9 | Comparative Example | 353 | 322 | 12 | 29 | 220 | 100 | Flattened structure | × |
| 10 | Comparative Example | 345 | 320 | 12 | 20 | 290 | 80 | Fibrous structure | × |
| 11 | Comparative Example | 350 | 325 | 11 | 20 | 290 | 80 | Fibrous structure | × |
| 12 | Comparative Example | 350 | 330 | 11 | 15 | 350 | 80 | Fibrous structure | × |
| 13 | Comparative Example | 352 | 330 | 11 | 15 | 360 | 80 | Fibrous structure | × |
| 14 | Comparative Example | 279 | 250 | 14 | 25 | 240 | 50 | Fibrous structure | × |
| 15 | Comparative Example | 275 | 252 | 14 | 25 | 250 | 50 | Fibrous structure | × |
| 16 | Comparative Example | 260 | 235 | 14 | 26 | 240 | 50 | Fibrous structure | × |
| 17 | Comparative Example | 264 | 239 | 14 | 26 | 240 | 50 | Fibrous structure | × |
| 18 | Comparative Example | 258 | 230 | 13 | 28 | 250 | 50 | Fibrous structure | × |
| 19 | Comparative Example | 257 | 230 | 13 | 28 | 240 | 50 | Fibrous structure | × |
| 20 | Comparative Example | 257 | 230 | 13 | 28 | 230 | 50 | Fibrous structure | × |
| 21 | Comparative Example | 260 | 235 | 13 | 27 | 270 | 50 | Fibrous structure | × |
| 22 | Comparative Example | 261 | 235 | 13 | 27 | 270 | 50 | Fibrous structure | × |

| | EXAMPLE 1 | COMPARATIVE EXAMPLE 1 |
|---|---|---|
| EXTRUDED MATERIAL MICROSTRUCTURE (500x MAGNIFICATION) | 100μm CRYSTAL GRAIN SIZE: 30 μm | FIG 100μm CRYSTAL GRAIN SIZE: 150 μm |

METHOD FOR PRODUCING HIGH-TOUGHNESS, HIGH-STRENGTH ALUMINUM ALLOY EXTRUDED MATERIAL WITH GOOD HARDENABILITY

CROSS REFERENCE TO RELATED APPLICATION

This application is based upon and claims the benefit of priority to Japanese Patent Application No. 2022-029782 filed on Feb. 28, 2022, the entire contents of which are incorporated herein by reference.

BACKGROUND

The present disclosure relates to methods for producing extruded materials made of Al—Mg—Si-based aluminum alloy, and more particularly, to a method suitable for producing a high-toughness, high-strength extruded material that exhibits good hardenability when air-cooled immediately after extrusion.

Extruded materials of aluminum alloys have been widely studied to reduce the weight of vehicles or the like.

Structural components or parts of vehicles are required not only to be lightweight, but also to exhibit good machinability in terms of, for example, bendability during production while having high strength, and in addition, to be high toughness from the viewpoint of ensuring impact resistance in use.

For example, JP-A-2016-20527 discloses an aluminum alloy with high strength and high toughness, but relates to a method for producing plates and is not directly applicable to producing extruded material.

JP-A-2011-208251 discloses an aluminum alloy extruded material with good bending crush resistance and corrosion resistance. However, the extruded material is inferior in productivity and quality because the extruded material is water-cooled immediately after extrusion and is therefore insufficient in hardenability, and in addition, likely to strain or deform during water cooling.

BRIEF DESCRIPTION OF THE DRAWINGS

FIGS. 1A and 1B illustrate aluminum alloy compositions used in evaluation tests;

FIGS. 2A and 2B illustrate the production conditions of extruded materials used in the evaluation tests;

FIGS. 3A and 3B illustrate evaluation results of the extruded materials;

DESCRIPTION OF EXEMPLARY EMBODIMENTS

Figures 4, 5:
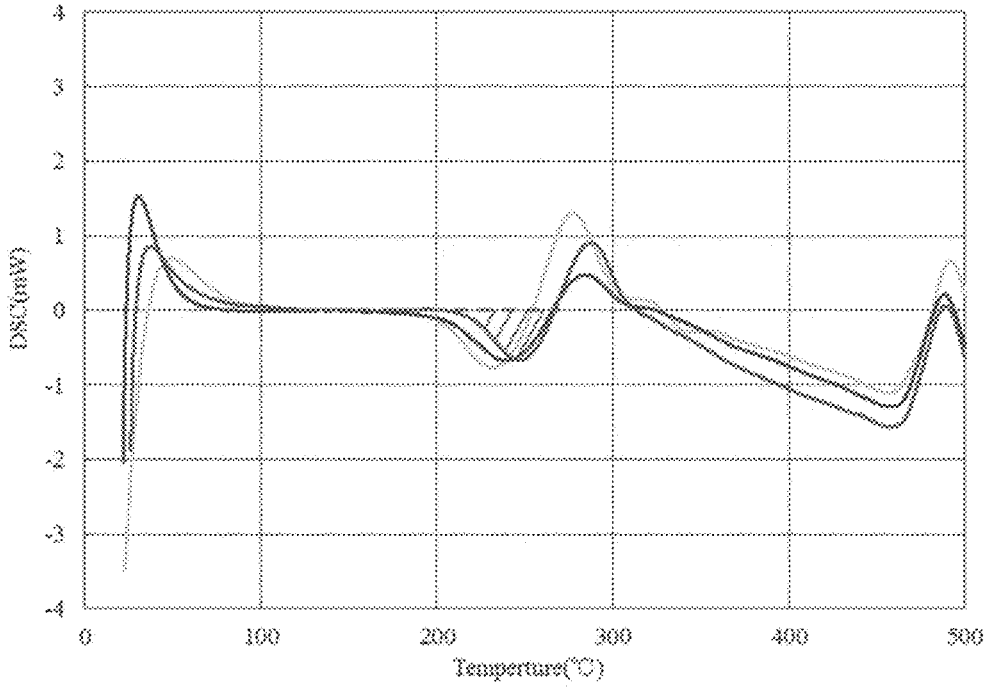
FIG. 4 illustrates differential scanning calorimetry (DSC) curves representing the amount of precipitation.
FIG. 5 illustrates micrographs of microstructures of extruded materials, each at the center of a cross section perpendicular to the extrusion direction.

The following disclosure provides many different embodiments, or examples, for implementing different features of the provided subject matter. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected or coupled to each other with one or more other intervening elements in between.

An object of the disclosure is to provide a method for producing an aluminum alloy extruded material that exhibits good hardenability when extruded and also has excellent toughness while having high strength.

In accordance with one of some embodiments, the method for producing an aluminum alloy extruded material includes: casting a billet at a casting speed of 60 mm/min or more using an aluminum alloy containing, by mass: 0.50 to 1.0% of Mg, 0.80 to 1.30% of Si, 0.10 to 0.60% of Mn, 0.05 to 0.35% of Fe, 0.35% or less of Cu, less than 0.10% of Cr, less than 0.10% of Zr, less than 0.10% of Zn, 0.10% or less of Ti, and the balance being aluminum and unavoidable impurities, the aluminum alloy having a stoichiometric $Mg_2Si$ content limited to 0.85 to 1.75% by mass with excess Si limited to 0.10 to 0.85% by mass, and a total Mn and Fe content of 0.15 to 0.95%; homogenizing the billet at 560 to 590° C. for 2 to 8 hours, followed by cooling at a rate of 50° C./h or more; preheating the billet at 400 to 550° C. and then extruding the billet into an aluminum alloy extruded material, cooling the aluminum alloy extruded material immediately after extruding from 460 to 550° C. at an average cooling rate of 350° C./min or more; and subsequently applying artificial aging treatment to the aluminum alloy extruded material.

For producing an extruded material of an aluminum alloy by extrusion, a cylindrical billet is loaded into a container of a direct or indirect extruder and pressed for extrusion through a die that is set in the container by pressing the billet from the rear with a stem. This extrusion for obtaining an aluminum alloy extruded material uses a cylindrical billet cast from a molten metal adjusted to a predetermined alloy composition.

Accordingly, the properties of the extruded material depend on the conditions for producing the extruded material as well as the alloy composition.

The reason for the selection of alloy compositions will be explained later, and the production and extrusion conditions or the like for the billet will first be described.

For casting an aluminum alloy into cylindrical billets, float casting, hot-top casting, casting with a heat-insulating mold, or the like is applied. In any case, heat-melted molten metal is teemed into the mold from the top of the mold and continuously cast downward while being cooled from the side.

At this time, the material is cast while being cooled to control the casting speed to 60 mm/min or more, so that the resulting billet has an average crystal grain size of 250 μm or less at the center of the cross section and the periphery, enabling the grain size to be kept fine after extrusion.

The billet cast as described above is subjected to homogenization (HOMO) because nonuniform micro-segregates are formed in the billet when the alloy solidifies.

In accordance with one of some embodiments, the billet was intended to be heated at 560 to 590° C. for 2 to 8 hours to allow the segregates to form a solid solution again and then cooled at a rate of 50° C./h or more, thereby homogenizing and fining precipitates.

The reason for the selection of alloy compositions is as follows.

Mg and Si

The aluminum alloy according to the disclosure is an Al—Mg—Si-based heat-treated alloy.

Mg and Si form intermediate precipitate phases of $Mg_2Si$ and thus impart high strength to the resulting alloy.

In this condition, when excess Si is present over the proportion of the stoichiometric $Mg_2Si$ composition, the alloy has higher strength.

However, when $Mg_2Si$ is excessively precipitated, the $Mg_2Si$ precipitates act as the starting point of the degradation of toughness and extrudability.

Accordingly, from such viewpoints, the aluminum alloy used herein was set such that it contains, by mass: 0.50 to 1.0% of Mg and 0.80 to 1.30% Si, with excess Si (exSi) in the range of 0.10 to 0.85% and $Mg_2Si$ in the range of 0.85% to 1.75% by mass. Mn, Fe, Cr, and Zr When a small amount of Mn is added, the precipitated Mn compound has the effect of acting as a preferential precipitation site for the $Mg_2Si$ intermediate precipitate phases and produces a sufficient quenching effect at a cooling rate of an air-cooling level in the cooling (die-end quenching) immediately after extrusion.

At this time, the temperature of the extruded material when cooling starts immediately after extrusion (cooling start temperature) is also important. It is preferable that cooling start temperature is controlled to be in the range of 460 to 550° C. and that the extruded material can be air-cooled at an average cooling rate is 350° C./min or more until the temperature of the extruded material reaches at least 200° C.

Additionally, adding Mn is effective in reducing the crystal grain size of the extruded material.

Fe, Cr, and Zr also belong to the group of transition metals as with Mn, and have a significant effect on the precipitation rate of precipitates in the quenching immediately after extrusion.

In particular, Cr is highly sensitive to quenching and cannot produce a sufficient quenching effect unless high-speed cooling is performed at a water-cooling level.

Fe acts effectively for quenching at an air-cooling-level rate and is also effective in improving hardenability and toughness because Fe suppresses recrystallization and facilitates the formation of a fibrous structure extending in the extrusion direction.

Fe, which forms various compounds with other constituents and causes segregation, has been considered one of the impurities and minimized accordingly.

In accordance with one of some embodiments, however, the aluminum alloy contains: 0.10 to 0.60% of Mn and 0.05 to 0.35% of Fe, with the total of Mn and Fe controlled in the range of 0.15 to 0.95%. Extruded materials of such an aluminum alloy exhibit good hardenability and has high toughness and strength.

Known high-strength materials are brittle, unfortunately. In one of some embodiments, however, the aluminum alloy extruded material can have both high toughness and high strength.

In accordance with one of some embodiments, Cr and Zr are considered as impurities that are better as they are less, and their contents are each set to less than 0.10%.

Cu

When a small amount of Cu is added, the Cu enters into solid solution to contribute to increasing strength, but an increased Cu content leads to degraded extrudability and corrosion resistance. Accordingly, when Cu is added, the Cu content is preferably 0.35% or less.

Zn

Zn does not have much effect on extrusion, but forms $MgZn_2$ precipitates that reduce the toughness and the resistance to stress corrosion cracking of the aluminum alloy extruded material. Accordingly, Zn is considered one of the impurities, and the Zn content is preferably less than 0.10%.

Ti

Ti is effective in forming finer crystal grains when aluminum alloys are cast into billets. Preferably, Ti is added in an amount of 0.10% or less.

In accordance with one of some embodiments, the aluminum alloy composition selected as described above is cast into a billet, and the billet is homogenized. After being preheated at 400 to 550° C., the homogenized billet is loaded into the container of an extruder and extruded, and the extruded material immediately after extrusion is cooled.

At that time, it is important to start cooling when the temperature of the extruded material immediately after extruding is 460 to 550° C., and the average cooling rate is preferably 350° C./min or higher.

This operation enables the resulting extruded material to have an average crystal grain size of 50 μm or less at a cross section in the direction perpendicular to the extrusion direction of the aluminum alloy extruded material.

The aluminum alloy extruded material is then subjected to artificial aging treatment at 160 to 220° C. for 2 to 12 hours and thus exhibits high toughness with a Charpy impact value of 20 $J/cm^2$ or more while having high strength with a 0.2% proof stress of 240 MPa or more and a tensile strength of 260 MPa or more.

As a result, in some embodiments, an aluminum alloy extruded material having high strength with a 0.2% proof stress of 240 MPa or more, a tensile strength of 260 MPa or more and high toughness with a Charpy impact value of 20 $J/cm^2$ or more can be produced.

Thus, some embodiments of the disclosure can be widely applied to the production of structural components of vehicles and industrial machinery.

Examples of the structural components include side members and other members, structural components of frames for mounting heavy loads, such as battery frames, and suspension members.

Exemplary embodiments are described below. Note that the following exemplary embodiments do not in any way limit the scope of the content defined by the claims laid out herein. Note also that all of the elements described in the present embodiment should not necessarily be taken as essential elements.

The molten metal of each alloy composition presented in FIGS. 1A and 1B was prepared and cast into an 8-inch billet at the casting speed presented in FIGS. 2A and 2B, followed by cutting to a predetermined length.

The billet may be cut after the homogenization described below.

Then, the billet was homogenized at the homogenization (HOMO) temperature and HOMO time presented in FIGS. 2A and 2B. After the homogenization, the billet was cooled at the cooling rate presented in FIGS. 2A and 2B.

Next, after being preheated to the billet (BLT) temperature presented in FIGS. 2A and 2B, the billet was extruded into an aluminum alloy extruded material at the extrusion speed presented in FIGS. 2A and 2B, immediately followed by air cooling (die-end quenching) at the cooling rate presented in FIGS. 2A and 2B. Then, the aluminum alloy extruded material was subjected to artificial aging treatment at the heat treatment temperature and heat treatment time presented in FIGS. 2A and 2B.

Here, it is preferable that the cooling immediately after extrusion is preferably started from a state where the temperature of the extruded material is 460 to 550° C. and that the average cooling rate is 350° C./min or more until the temperature of the extruded material is 200° C. or less.

In addition, the tables in FIGS. 2A and 2B show the preferable range of each condition.

The evaluation results of the extruded materials prepared as described above are presented in FIGS. 3A and 3B.

Evaluation methods are as described below.

Mechanical Properties

JIS No. 5 test pieces were cut out of the extruded materials in the extrusion direction in accordance with JIS-Z2241. The test pieces were subjected to tests with a tensile tester in accordance with the JIS standard to measure T5 tensile strength (MPa), T5 0.2% proof strength (MPa), and T5 elongation (%).

Crystal Grain Size

Samples were cut out of the extruded materials at the center of a cross section that is perpendicular to the extrusion direction. After being mirror-finished, each sample was etched with 3% NaOH aqueous solution.

The metallographic structure of the extruded material was thus observed by optical microscopy, and the average grain size was measured using an image at a magnification of 500 times.

FIG. 5 presents micrographs used for this measurement.

Example 1 in FIG. 5 has an average crystal grain size of 30 μm which is finer than the average crystal grain size of Comparative Example 1 in FIG. 5, which is 150 μm.

Impact Test

JIS No. 4 V-notch test pieces were made in the extrusion direction of the extruded materials in accordance with JIS-Z2242. The test pieces were subjected to a Charpy impact test with a Charpy impact tester in accordance with the JIS standard.

DSC Analysis

Extruded materials were subjected to differential thermal analysis with a differential thermal analyzer, Thermo plus evo2, manufactured by Rigaku Corporation. The area (integral value with mW/g) of the hatched endothermic peak in the chart depicted in FIG. 4 was regarded as equivalent to the amount of precipitation.

The chart shown in FIG. 4 is the result of using a 100 mg test piece, and the measured value of the endothermic peak area was 20 to 30 mW. When the measured value is converted into (mW/g) units, the target amount of precipitation in DSC analysis is 200 mW/g or more, preferably in the range of 200 to 300 mW/g.

The evaluation results presented in FIGS. 3A and 3B show that Examples 1 to 35 meet all the quality targets.

In contrast, Comparative Examples 1 to 5 each had a Si content lower than the lower limit of 0.80% in the disclosure, and an exSi content lower than the lower limit of 0.10% in the disclosure, thus being insufficient in strength or toughness.

In Comparative Examples 6 and 7, the contents of Mg and Fe were smaller than the lower limits in the disclosure, and the strength did not meet the target.

Comparative Examples 8 and 9 are examples in which the Si content is small and the Mg content is large, and Comparative Examples 10 to 17 show examples in which the cooling conditions immediately after extrusion are off from the target conditions.

In particular, in Comparative Examples 10 to 13, since the temperature of the extruded material (cooling start temperature) immediately after extrusion exceeded 550° C., bulging defects occurred on the surface.

Comparative Examples 18 to 22 are examples in which cooling of the billet after homogenization treatment is slow.

More specifically, the compositions of Examples 1 to 19 were the same and contained 0.95% of Si, 0.15% of Fe, 0.51% of Mn, and 0.77% of Mg with a $Mg_2Si$ content of 1.35%, an exSi content of 0.33%, a total Mn and Fe content of 0.66%, and neither Cu nor Cr.

For the effect of the cooling rate immediately after extrusion as a production condition, as the cooling rate depending on the intensity of the air-cooling fan was increased or as the extrusion speed was increased, the aluminum alloy extruded material tended to exhibit higher proof stress and higher tensile strength, but the Charpy impact value did not change much.

Examples 20 to 23 each contained 0.30% of Cu.

In Examples 20 to 23, the aluminum alloy extruded materials tended to have slightly high strength while the elongation and the Charpy impact value were not reduced. Accordingly, Cu is preferably added within 0.35%.

For example, the Cu content may be 0.15 to 0.35%, more preferably 0.20% to 0.35%.

Examples 24 to 29 show the aluminum alloy extruded materials including Si: 1.00%, and Examples 30 to 35 show the aluminum alloy extruded materials including Si: 0.85%. The higher the Si content, the higher the strength and yield strength.

In addition, in Comparative Examples 5, 6, and 7, the DSC analysis shows that the endothermic peak area is less than 200 mW/g, and the T5 tensile strength and T5 yield strength are relatively low.

It is presumed that $Mg_2Si$ and exSi of Comparative Examples 5, 6, and 7 are out of the condition range.

Although only some embodiments of the present disclosure have been described in detail above, those skilled in the art will readily appreciate that many modifications are possible in the embodiments without materially departing from the novel teachings and advantages of this disclosure. Accordingly, all such modifications are intended to be included within scope of this disclosure.

What is claimed is:

1. A method for producing an aluminum alloy extruded material, comprising:

casting a billet at a casting speed of 60 mm/min or more using an aluminum alloy, the aluminum alloy containing, by mass: 0.50 to 1.0% of Mg, 0.80 to 1.30% of Si, 0.36 to 0.60% of Mn, 0.05 to 0.35% of Fe, 0.35% or less of Cu, less than 0.10 of Cr, less than 0.10% of Zr, less than 0.10% of Zn, 0.10% or less of Ti, and the balance being aluminum and unavoidable impurities, the aluminum alloy having a stoichiometric $Mg_2Si$ content limited to 1.35 to 1.75% with excess Si limited to 0.33 to 0.85%, and a total Mn and Fe content of 0.41% to 0.95% by mass;

homogenizing the billet at 560 to 590° C. for 2 to 8 hours, followed by cooling the billet at a rate of 50° C./h or more;

preheating the billet at 400 to 550° C. and then extruding the billet into an aluminum alloy extruded material, cooling the aluminum alloy extruded material immediately after extruding from 460 to 550° C. at an average cooling rate of 350° C./min or more; and subsequently applying artificial aging treatment to the aluminum alloy extruded material.

2. The method according to claim 1, wherein the aluminum alloy extruded material obtained through the method has an average crystal grain size of 50 μm or less at a cross section in the direction perpendicular to an extrusion direction.

3. The method according to claim 1, wherein the artificial aging treatment is performed at 160 to 220° C. for 2 to 12 hours, and the aluminum alloy extruded material after the artificial aging treatment has a 0.2% proof stress of 240 MPa or more and a Charpy impact value of 20 $J/cm^2$ or more.

4. The method according to claim 2, wherein the artificial aging treatment is performed at 160 to 220° C. for 2 to 12 hours, and the aluminum alloy extruded material after the artificial aging treatment has a 0.2% proof stress of 240 MPa or more and a Charpy impact value of 20 $J/cm^2$ or more.

* * * * *